US011530838B2

(12) United States Patent
Anliker et al.

(10) Patent No.: US 11,530,838 B2
(45) Date of Patent: Dec. 20, 2022

(54) HVAC ACTUATOR WITH HEATING APPARATUS

(71) Applicant: BELIMO HOLDING AG, Hinwil (CH)

(72) Inventors: Reto Anliker, Schönholzerswilen (CH); Paul Guyer, Dürnten (CH); Silvio Grogg, Gossau / ZH (CH)

(73) Assignee: BELIMO HOLDING AG, Hinwil (CH)

( * ) Notice: Subject to any disclaimer, the term of this patent is extended or adjusted under 35 U.S.C. 154(b) by 44 days.

(21) Appl. No.: 16/316,217

(22) PCT Filed: Sep. 5, 2017

(86) PCT No.: PCT/EP2017/072185
§ 371 (c)(1),
(2) Date: Jan. 8, 2019

(87) PCT Pub. No.: WO2018/059883
PCT Pub. Date: Apr. 5, 2018

(65) Prior Publication Data

US 2019/0309983 A1 Oct. 10, 2019

(30) Foreign Application Priority Data

Sep. 30, 2016 (CH) ..... 01292/16

(51) Int. Cl.
*F24F 13/22* (2006.01)
*F24F 140/30* (2018.01)

(52) U.S. Cl.
CPC ..... *F24F 13/22* (2013.01); *F24F 2013/221* (2013.01); *F24F 2140/30* (2018.01); *F24F 2221/34* (2013.01)

(58) Field of Classification Search
CPC .. F24F 13/22; F24F 2013/221; F24F 2221/34; F24F 2140/30; F24F 11/047
(Continued)

(56) References Cited

U.S. PATENT DOCUMENTS 4,813,474 A * 3/1989 Umezu ..... F25B 49/02 62/176.5
6,470,696 B1 * 10/2002 Palfy ..... G01N 25/56 62/3.4

(Continued)

FOREIGN PATENT DOCUMENTS

CN 202421923 U 9/2012
CN 103235621 A 8/2013

(Continued)

OTHER PUBLICATIONS

International Search Report of PCT/EP2017/072185 dated Nov. 20, 2017 [PCT/ISA/210].

(Continued)

*Primary Examiner* — Nelson J Nieves
*Assistant Examiner* — Meraj A Shaikh
(74) *Attorney, Agent, or Firm* — Sughrue Mion, PLLC

(57) ABSTRACT

An HVAC actuator (1) comprises a motor (12), a motor controller (13) coupled to the motor (12), and a heating apparatus (14) thermally coupled to the HVAC actuator (1). The HVAC actuator (1) further comprises a condensation controller (15) coupled to the heating apparatus (14). The condensation controller (15) is configured to monitor at least one condensation parameter, and to control the heating apparatus (14) using the at least one condensation parameter.

10 Claims, 3 Drawing Sheets

(58) Field of Classification Search
USPC ..... 137/334
See application file for complete search history.

(56) References Cited

U.S. PATENT DOCUMENTS

| | | | | |
|---|---|---|---|---|
| 10,393,395 | B1 * | 8/2019 | Gardner | F24F 11/0001 |
| 2011/0159795 | A1 * | 6/2011 | Sprague | F24F 7/007 236/49.3 |
| 2013/0192677 | A1 * | 8/2013 | Kriz | F16K 49/002 137/341 |
| 2013/0340448 | A1 * | 12/2013 | Puranen | F24F 3/153 62/90 |
| 2014/0045419 | A1 * | 2/2014 | Bartmann | E06B 7/10 454/200 |
| 2014/0048244 | A1 * | 2/2014 | Wallace | G05D 7/0617 165/253 |
| 2015/0064639 | A1 * | 3/2015 | Dumbreck | F24D 19/1096 432/49 |
| 2016/0290675 | A1 * | 10/2016 | Hashino | F24F 11/62 |

FOREIGN PATENT DOCUMENTS

| | | | |
|---|---|---|---|
| CN | 103398570 | A | 11/2013 |
| CN | 103441433 | A | 12/2013 |
| CN | 104949434 | A | 9/2015 |
| CN | 204942092 | U | 1/2016 |
| JP | 10-061809 | A | 3/1998 |
| JP | 10061809 | A * | 3/1998 |
| JP | 11-230396 | A | 8/1999 |
| JP | 2006-112501 | A | 4/2006 |

OTHER PUBLICATIONS

Written Opinion of PCT/EP2017/072185 dated Nov. 20, 2017 [PCT/ISA/237].

Swiss Search Report of CH 1292/2016 dated Feb. 3, 2017 [PCT/ISA/201].

Communication dated Jun. 28, 2020 by National Intellectual Property Administration, P R. China in application No. 201780058029.7.

Translation of Office Action dated Aug. 4, 2021 from the China National Intellectual Property Administration in CN Application No. 201780058029.7.

Communication dated May 3, 2022 from the European Patent Office in European Application No. 17 765 391.2.

* cited by examiner

HVAC ACTUATOR WITH HEATING APPARATUS

CROSS REFERENCE TO RELATED APPLICATIONS

This application is a National Stage of International Application No. PCT/EP2017/072185, filed Sep. 5, 2017, claiming priority based on Swiss Patent Application No. 01292/16, filed Sep. 30, 2016.

FIELD OF THE INVENTION

The present invention relates to an HVAC actuator and a method to operate an HVAC actuator, in particular, an HVAC actuator with a heating apparatus.

BACKGROUND OF THE INVENTION

In the field of Heating, Ventilation and Air Conditioning (HVAC) technology, HVAC actuators are used to control HVAC devices, such as dampers, blend doors or valves for example. Accurate control of the HVAC devices is important for ensuring thermal comfort as well as achieving energy efficiency. Accordingly, accurate control is in particular required for the HVAC actuators configured to drive and regulate mechanical HVAC devices. For the purpose of improving precision and reliability, HVAC actuators often feature position or speed sensors for providing information about the position or speed of drive components of the HVAC actuator, such as the motor or the drive unit, which information is used to control, for example, the motion of an output shaft of the HVAC actuator. In addition, reliable control of the HVAC actuator is also important with regards to safety issues, when HVAC actuators are used for fire or smoke dampers, for example.

On the other hand, owing to the frequent positioning of the HVAC devices at interfaces between outdoor and indoor areas of buildings or vehicles, the HVAC actuators are usually exposed to strongly varying environmental conditions of operation, such as varying temperature, air humidity and/or pressure. The varying environmental conditions can have serious impacts on the performance of the HVAC actuators, as the performance of bearings, motor resistance or frictional forces in general, for example, may significantly change with the environmental conditions. In particular, varying temperature in connection with air humidity can lead to condensation inside the housing of the HVAC actuator, negatively affecting the components of the HVAC actuator, both, in terms of accurate control and decreased durability, e.g. due to corrosion. Furthermore, a varying performance and behavior of HVAC actuator components can lead to a decrease in energy efficiency because of an increase in power consumption of actuator components.

SUMMARY OF THE INVENTION

It is an object of the invention to provide an HVAC actuator and a method to operate an HVAC actuator, which at least partially improve the prior art and avoid at least part of the mentioned disadvantages of the prior art.

According to the present invention, this object is achieved by the features of the independent claims. In addition, further advantageous embodiments follow from the dependent claims and the description.

According to an aspect of the invention, the object is achieved by an HVAC actuator, comprising: a motor; a motor controller coupled to the motor; and a heating apparatus thermally coupled to the HVAC actuator. The object is particularly achieved in that the HVAC actuator further comprises a condensation controller coupled to the heating apparatus; the condensation controller being configured to monitor at least one condensation parameter, and to control the heating apparatus using the at least one condensation parameter. The at least one condensation parameter is related to varying environmental conditions, such as temperature, humidity, air pressure, etc., which potentially have an influence on condensation inside the housing of the HVAC actuator.

In an embodiment, the HVAC actuator further comprises a sensing device configured to detect the at least one condensation parameter. Having a sensing device integrated in the HVAC actuator has the advantage that the HVAC actuator can determine condensation parameters by itself, without extensive additional add-ons or extensions. Further, by placing the sensing device in the vicinity of the HVAC actuator components, especially inside the housing of the HVAC actuator, the local ambient conditions affecting the HVAC actuator components in a relevant manner can be reliably determined.

In an embodiment, the sensing device comprises a humidity sensor configured to detect humidity as a condensation parameter. Because of the small size of available humidity sensors, their integration into HVAC actuators does not require significant and expensive modifications of the structure of the HVAC actuators.

In an embodiment, the humidity sensor is a capacitive humidity sensor. Capacitive humidity sensors are advantageous because of their precision, small size, as well as energy efficiency, such that integration into HVAC actuators may be easily achieved.

The sensing device may further comprise a temperature sensor configured to detect temperature as a condensation parameter.

In an embodiment, the condensation controller is configured to compare the at least one condensation parameter with a condensation threshold, and to control the heating apparatus using the at least one condensation parameter and the condensation threshold. The condensation threshold may typically be related to the dew point inside the housing of the HVAC actuator. Alternatively or in addition, the defined condensation threshold may further be related to properties such as tolerance values of the HVAC actuator components.

In an embodiment, the HVAC actuator further comprises a memory unit configured to store one or more condensation thresholds.

In an embodiment, the condensation controller is configured to select the condensation threshold using the condensation parameter. Using a particular monitored condensation parameter, the condensation controller may select a particular condensation threshold from a set of condensation thresholds stored in the memory unit; the selected condensation threshold corresponding to the particular, current condensation parameter that reflects the instantaneous environmental condition, such as the humidity.

In an embodiment, the condensation controller is configured to control the heating apparatus by turning on the heating apparatus, turning off the heating apparatus, and/or increasing the heating power of the heating apparatus.

In an embodiment, the condensation controller is configured to generate the condensation threshold indicating a critical humidity.

In an embodiment, the HVAC actuator further comprises a communication apparatus configured to receive the at least one condensation parameter and/or at least one condensation threshold from a database or a remote computer system. The communication apparatus for remote control of the condensation controller has the advantage that precautionary measures for avoiding condensation inside the HVAC actuator may be taken remotely and in a centralized manner. For example, this has the advantage that updated characteristics of the HVAC actuator components may be taken into account by the condensation controller for avoiding condensation, for example by adjusting the condensation thresholds) in light of increased tolerances of some HVAC actuator components. As a further example, condensation parameters may be centrally distributed to condensation controllers of several HVAC actuators which are installed in locations with similar ambient conditions, for example in a single building or for the same floor of a series of buildings. Centralized distribution of condensation parameters may provide the advantage of increased control and reliability and increased efficiency in condensation avoidance.

According to a further aspect, the present invention is also directed to a method of operating an HVAC actuator comprising a motor, a motor controller coupled to the motor, and a heating apparatus thermally coupled to the HVAC actuator, whereby the method comprises: monitoring, by a condensation controller of the HVAC actuator, of at least one condensation parameter; and controlling the heating apparatus, by the condensation controller, using the at least one condensation parameter.

In an embodiment, monitoring at least one condensation parameter includes detecting a condensation parameter by a sensing device of the HVAC actuator.

In an embodiment, the condensation controller compares the at least one condensation parameter to a condensation threshold and controls the heating apparatus using the at least one condensation parameter and the condensation threshold.

In an embodiment, the condensation controller controls the heating apparatus by turning on the heating apparatus, turning off the heating apparatus, and increasing the heating power of the heating apparatus.

BRIEF DESCRIPTION OF THE DRAWINGS

The present invention will be explained in more detail, by way of example, with reference to the drawings in which.

DETAILED DESCRIPTION OF THE PREFERRED EMBODIMENTS

Figure 1:
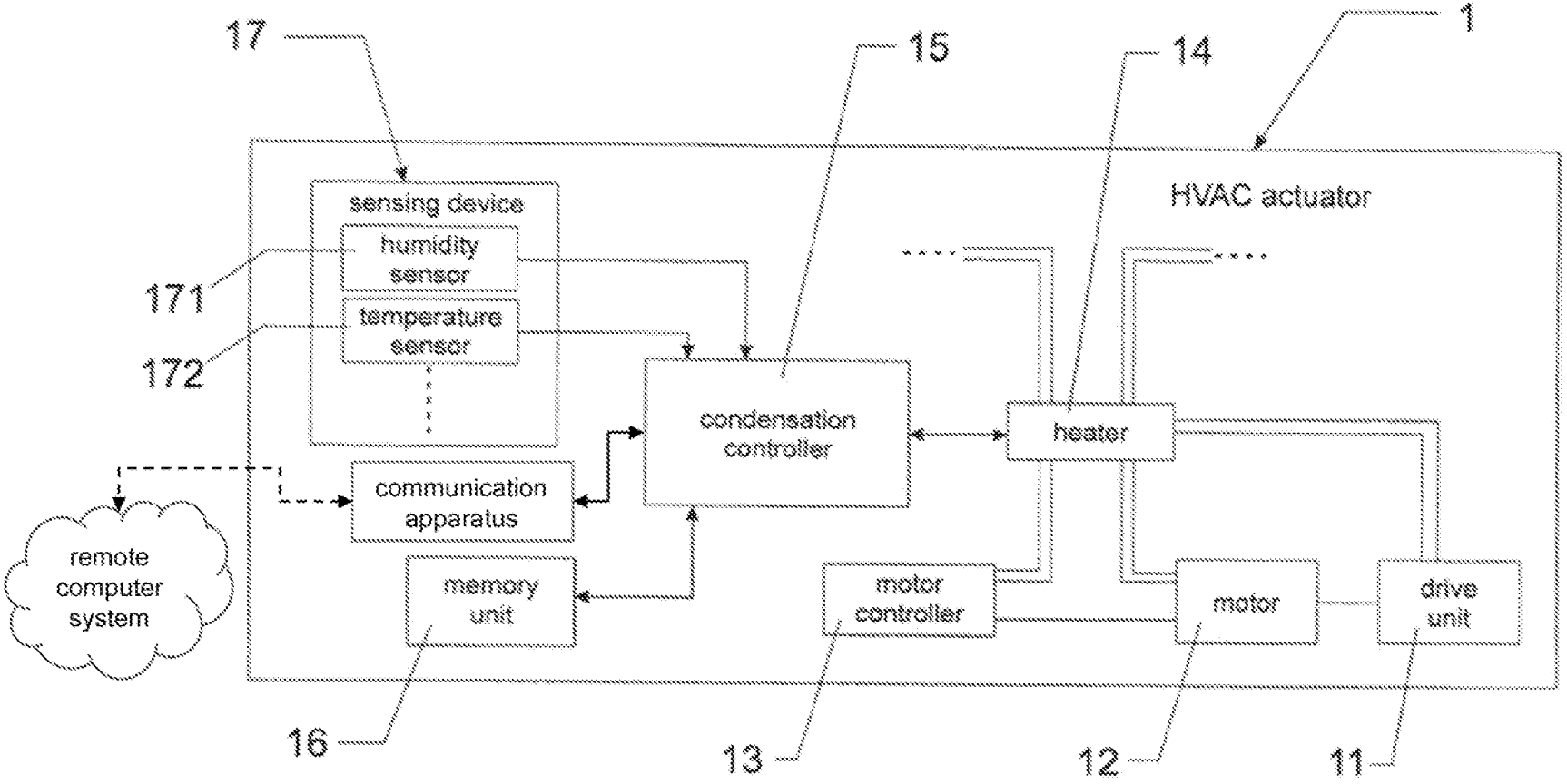
FIG. 1: shows a block diagram illustrating schematically an HVAC actuator comprising a heating apparatus.

FIG. 1 shows a block diagram of an embodiment of an HVAC actuator 1. A heater 14 is arranged inside the HVAC actuator 1 and thermally coupled to a drive unit 11, a motor 12, and a motor controller 13; the thermal coupling is symbolized by double lines.

Further thermal couplings to further (not illustrated) components of the HVAC actuator 1 are indicated by two additional double lines. The heater 14 may be a resistive or an inductive heater. Alternatively, the heater 14 may be implemented by exploiting the currents in the coils of the motor. The heater 14 may be coupled to a printed circuit board (PCB) arranged inside the HVAC actuator 1. Additionally, the heater 14 may feature a variable heating power. Optionally, the HVAC actuator 1 may comprise additional heaters, thermally coupled to components of the HVAC actuator 1.

The motor 12 is operatively coupled to the drive unit 11. The motor controller 13 is coupled to the motor 12. The heater 14 is coupled to a condensation controller 15, as indicated by the double arrow. The condensation controller 15 controls the heating apparatus 14, for example for turning the heater 14 on or off, or to increase or decrease the heating power. In a variant, the condensation controller 15 and the motor controller 13 may be integrated in a central controller unit (not illustrated). The condensation controller 15 may comprise electronic circuitry with components such as for example (programmed) microprocessors, microcontrollers, ASICs or discrete electronic components. The condensation controller 15 is configured to monitor at least one condensation parameter and to control the heater 14 using the at least one condensation parameter.

The condensation controller 15 is coupled to a memory unit 16, such that condensation thresholds stored in the memory unit 16 can be accessed by the condensation controller 15. The memory unit 16 may further store other data or signals such as, for example, detected condensation parameters or commands for the heater 14. The memory unit 16 may be integrated into the condensation controller 15. Alternatively, the memory unit 16 may be part of a memory of the motor controller 13.

The condensation controller 15 is further coupled to a sensing device 17 from which the condensation controller 15 obtains (reads out) condensation parameters. The sensing device 17 comprises a humidity sensor 171 and a temperature sensor 172. The condensation parameters read from the sensing device 17 includes the humidity detected by the humidity sensor 171 and/or the temperature detected by the temperature sensor 172. In an embodiment, the sensing device 17 comprises further sensors, as indicated by the dotted line in FIG. 1.

The sensing device 17 may be read out by the condensation controller 15 continuously or periodically with a certain rate. The sensing device 17 may be periodically read out by the condensation controller 15 after each heating command sent to the heater 14 by the condensation controller 15. This has the advantage that the HVAC actuator 1 may be adjusted continuously to the environmental conditions, for avoiding the components to be negatively affected by condensation.

Figure 2:
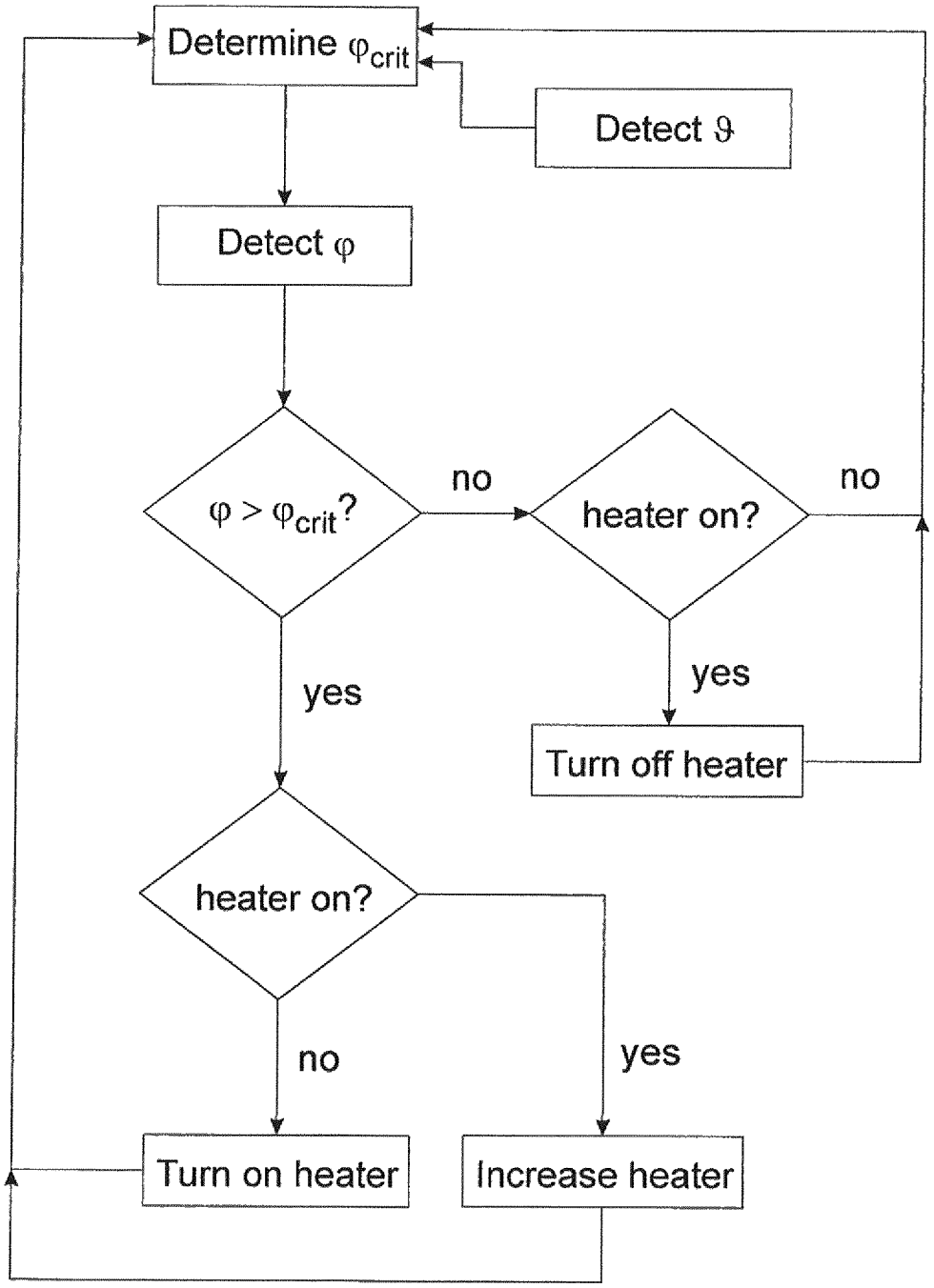
FIG. 2: shows a flow diagram illustrating an exemplary sequence of steps for operating the HVAC actuator.

FIG. 2 shows a flow diagram for operating the HVAC actuator 1 illustrated in FIG. 1. First, a condensation threshold is defined. For a condensation parameter below the condensation threshold, the performance of the HVAC actuator 1 can be maintained, without being unacceptably negatively affected by effects of environmental conditions, such as condensation. The condensation threshold therefore defines an allowable range or allowable ranges for the at least one condensation parameter. In FIG. 2, the condensation threshold is expressed by a critical humidity $\varphi_{crit}$ which is determined by the condensation controller 15 using the temperature $\vartheta$ detected by the temperature sensor 172. The critical humidity $\varphi_{crit}$ is determined as follows: The condensation controller 15 accesses the memory unit 16 which has stored therein a set of critical humidity values $\varphi_{crit}(\vartheta)$ which depend on the temperature $\vartheta$. Using the detected temperature $\vartheta$, the condensation controller 15 selects the critical humidity $\varphi_{crit}$ corresponding to the detected temperature $\vartheta$. The critical humidity values $\varphi_{crit}(\vartheta)$ are typically related to the dew point and to properties of the components of the HVAC actuator 1. After or in parallel to the step of determining the critical humidity $\varphi_{crit}$, the humidity $\varphi$ is detected using the humidity sensor 171. The condensation controller 15 compares the humidity $\varphi$ to the critical humidity $\varphi_{crit}$. For the case that the humidity $\varphi$ is greater than the critical humidity $\varphi_{crit}$, the humidity $\varphi$ is in a range where condensation can have a detrimental effect to components of the HVAC actuator 1. For the purpose of comparing the humidity $\varphi$ with the critical humidity $\varphi_{crit}$, the condensation controller 15 may comprise a comparator. After the comparison, the condensation controller 15 monitors whether the heater 14 is turned on or off. Optionally, the condensation controller 15 may monitor the heating power of the heater 14. Depending on the outcome of the comparison of the humidity $\varphi$ and the critical humidity $\varphi_{crit}$, and depending on whether the heater 14 is turned on or off, different commands such as turning on, turning off the heater 14 or increasing the heating power are triggered. For the case that the humidity $\varphi$ is smaller than the critical humidity $\varphi_{crit}$, the heater 14 is turned off, if the heater 14 was turned on; or the heater 14 is left idle, if the heater 14 was already turned off. For the case that the humidity $\varphi$ is larger than the critical humidity $\varphi_{crit}$, the heater 14 is turned on, if the heater 14 was turned off; or the heating power is increased, if the heater 14 was already turned on. After controlling the heater 14, operation returns to the step of determining the critical humidity $\varphi_{crit}$. After monitoring and controlling the heater 14, the environmental conditions, especially inside the housing of the HVAC actuator 1, have typically changed, such that the condensation controller 15 may start again with determining the condensation threshold and monitoring the at least one condensation parameter.

Figure 3:
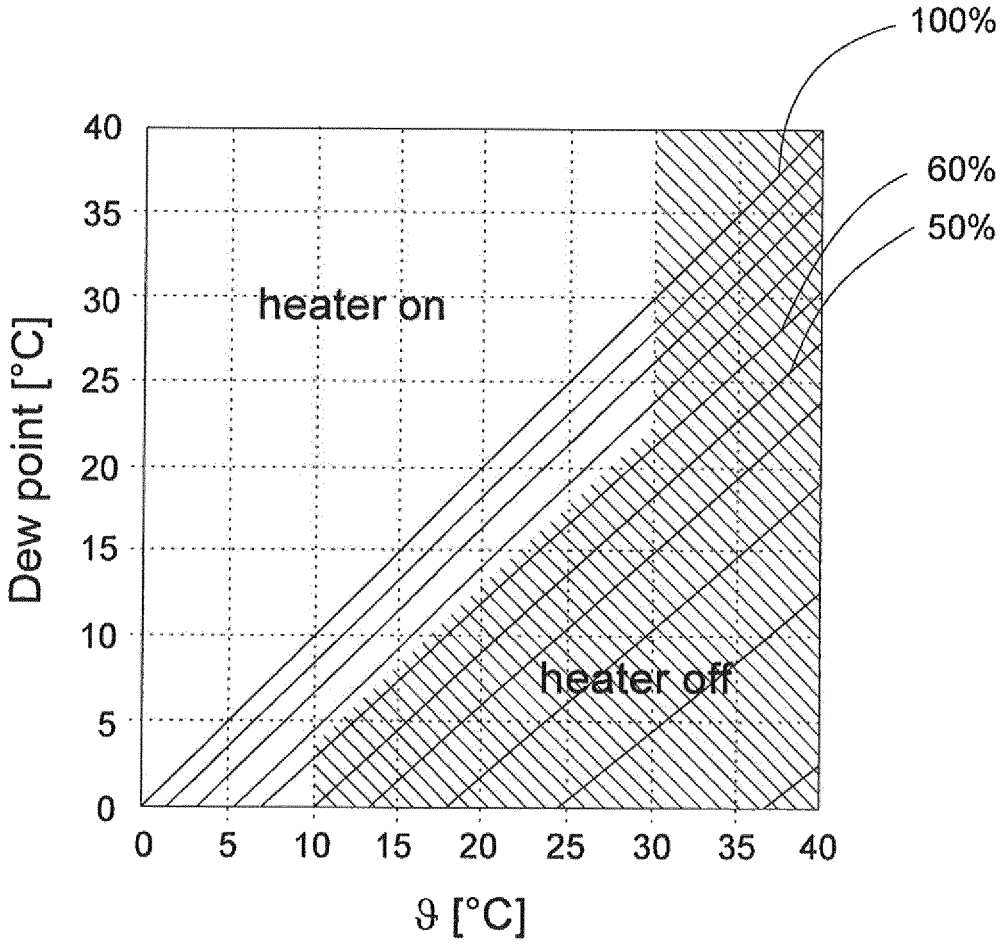
FIG. 3: shows a diagram with parameter ranges for controlling the heating apparatus.

FIG. 3 shows a diagram with different ranges of heater controls as a function of the temperature $\vartheta$, the dew point and in dependence of the humidity $\varphi$, based on the Magnus Formula. Sloped lines indicate the relative humidity, of which three exemplary values are labeled in FIG. 3. Along the line of relative humidity of 100%, the temperature $\vartheta$ indicates the dew point. By detecting the temperature $\vartheta$ in addition to the humidity $\varphi$, the dew point inside the housing of the HVAC actuator may be determined. For the particular detected temperature $\vartheta$ and the humidity $\varphi$, a condensation threshold may be defined. The defined condensation threshold may be such that the temperature $\vartheta$ may be greater than the dew point by an amount for which condensation is safely avoided. As can be seen in the diagram of FIG. 3, the heater 14 is set to be always on, below a temperature $\vartheta$ of 10° C. Above a temperature $\vartheta$ of 30° C., the heater 14 is always set to be off. In between, the heater 14 is turned on, if the relative humidity exceeds a value of 65%. The critical humidity $\varphi_{crit}$ for this temperature range is therefore 65%. In other embodiments, other ranges with other values of the critical humidity $\varphi_{crit}$ may be defined. For example, below a temperature of 15° C., the heater 14 may be set to be turned on as soon as the relative humidity exceeds 45%. Above a temperature of 25° C., the heater 14 may be set to be turned on, as soon as the relative humidity exceeds 80%. In between, the heater 14 may be turned on, if the relative humidity exceeds 60%. Diagrams such as the one shown in FIG. 3, with ranges and values of condensation thresholds, may be stored in the memory unit 16 for example as tables or as functions and retrieved by the condensation controller 15.

By using the condensation controller 15 according to the described method, a smart and reliable heating method for adapting to varying environmental conditions, especially for avoiding detrimental condensation inside the housing of the HVAC actuator 1, may be achieved. The method has the particular advantage that an avoidance of condensation may be achieved without requiring a user of the HVAC actuator 1 being active, i.e. without additional external intervention, for example for controlling the heater 14.

The invention claimed is:

1. An HVAC actuator (1), comprising:

a motor (12);

a motor controller (13) coupled to the motor (12); and a heating apparatus (14) arranged inside the HVAC actuator (1) and thermally coupled to the HVAC actuator (1);

wherein the HVAC actuator (1) further comprises a condensation controller (15) coupled to the heating apparatus (14); the condensation controller (15) being configured to monitor at least—two condensation parameters inside the HVAC actuator (1), wherein the HVAC actuator (1) further comprises a sensing device (17) arranged inside the HVAC actuator (1) configured to detect the at least two condensation parameters inside the HVAC actuator (1), wherein the HVAC actuator (1) further comprises a memory unit (16) configured to store a set of condensation thresholds as tables or as functions, wherein the set of condensation thresholds relate to a dew point inside the HVAC actuator (1), wherein the condensation controller (15) is configured to select a condensation threshold, from the set of condensation thresholds stored in the memory unit (16) using at least one of the two detected condensation parameters, and wherein the condensation controller (15) is configured to compare the at least one of the two detected condensation parameters to the selected condensation threshold, and to control the heating apparatus (14) using at least one of the condensation parameters and the selected condensation threshold in accordance with the comparison to avoid condensation inside the HVAC actuator (1).

2. The HVAC actuator (1) according to claim 1, wherein the sensing device (17) comprises a humidity sensor (171) configured to detect humidity as a condensation parameter.

3. The HVAC actuator (1) according to claim 2, wherein the humidity sensor (171) is a capacitive humidity sensor.

4. The HVAC actuator (1) according to claim 1, wherein the sensing device (17) comprises a temperature sensor (172) configured to detect temperature as a condensation parameter.

5. The HVAC actuator (1) according to claim 1, wherein the condensation controller (15) is configured to control the heating apparatus (14) by performing at least one of: turning on the heating apparatus (14), turning off the heating apparatus (14), and increasing a heating power of the heating apparatus (14).

6. The HVAC actuator (1) according to claim 1, wherein the condensation controller (15) is configured to generate the condensation threshold indicating a critical humidity.

7. A method of operating an HVAC actuator (1) comprising a motor (12), a motor controller (13) coupled to the motor (12), and a heating apparatus (14) arranged inside HVAC actuator (1) and thermally coupled to the HVAC actuator (1), the method comprising:

monitoring, by a condensation controller (15) of the HVAC actuator (1), of at least two condensation parameters inside the HVAC actuator (1); and wherein the monitoring of at least one condensation parameter includes detecting the condensation parameter by a sensing device (17) arranged inside the HVAC actuator (1), wherein the HVAC actuator (1) further comprises a memory unit (16) configured to store a set of condensation thresholds as tables or as functions, wherein the set of condensation thresholds relate to a dew point inside the HVAC actuator (1), wherein the condensation controller (15) selects a condensation threshold, from the set of condensation thresholds stored in the memory unit (16) using at least one of the two detected condensation parameters, and wherein the condensation controller (15) compares the at least one of the two condensation parameters to the selected condensation threshold and controls the heating apparatus (14) using at least one of the condensation parameters and the selected condensation threshold in accordance with the comparison to avoid condensation inside the HVAC actuator (1).

8. The method according to claim 7, wherein the condensation controller (15) controls the heating apparatus (14) by performing at least one of: turning on the heating apparatus (14), turning off the heating apparatus (14), and increasing a heating power of the heating apparatus (14).

9. The HVAC actuator (1) according to claim 1, wherein the heating apparatus (14) is set to be always on in case a detected temperature as one of the condensation parameters is below a predefined temperature, and wherein the heating apparatus (14) is set to be always off in case the detected temperature as one of the condensation parameters is above a predefined temperature.

10. The method of operating an HVAC actuator (1) according to claim 7, wherein the heating apparatus (14) is set to be always on in case a detected temperature as one of the condensation parameters is below a predefined temperature, and wherein the heating apparatus (14) is set to be always off in case the detected temperature as one of the condensation parameters is above a predefined temperature.

* * * * *